United States Patent [19]

Anderson et al.

[11] 4,318,554

[45] Mar. 9, 1982

[54] COMBINED MEDICAL AND/OR INFORMATIONAL IDENTIFICATION CREDIT CARD

[75] Inventors: Thomas P. Anderson, Winnetka; Richard G. Bramley, Northbrook, both of Ill.

[73] Assignee: Microseal Corporation, Zion, Ill.

[21] Appl. No.: 74,249

[22] Filed: Sep. 10, 1979

[51] Int. Cl.[3] ..... B42D 15/00; G09F 3/02

[52] U.S. Cl. ..... 283/7; 283/6; 40/2.2; 156/290

[58] Field of Search ..... 283/7, 6; 40/2.2, 158; 156/290

[56] References Cited

U.S. PATENT DOCUMENTS

| | | | |
|---|---|---|---|
| 3,457,661 | 7/1969 | Peters | 283/7 X |
| 3,566,521 | 3/1971 | Conner | 283/7 X |
| 3,679,512 | 7/1972 | Macone | 156/290 X |
| 3,792,542 | 2/1974 | Cohan | 40/2.2 X |
| 3,810,566 | 5/1974 | Adams | 40/158 B X |
| 3,855,033 | 12/1974 | Staats | 283/7 X |
| 4,070,774 | 1/1978 | Staats | 40/2.2 |
| 4,096,015 | 6/1978 | Kawamata | 283/7 |

*Primary Examiner*—Paul A. Bell
*Assistant Examiner*—John S. Brown
*Attorney, Agent, or Firm*—Hill, Van Santen, Steadman, Chiara & Simpson

[57] ABSTRACT

A medical and/or informational identification credit card has multiple laminar parts partially heat-sealed in a localized area to permit high speed embossment in automatic equipment, whereupon a customized informational part, such as a microfilm chip or photograph, matched to the embossed identification on the partially laminated card may be inserted and locked in place by a full lamination of the card.

11 Claims, 9 Drawing Figures

Fig. 1
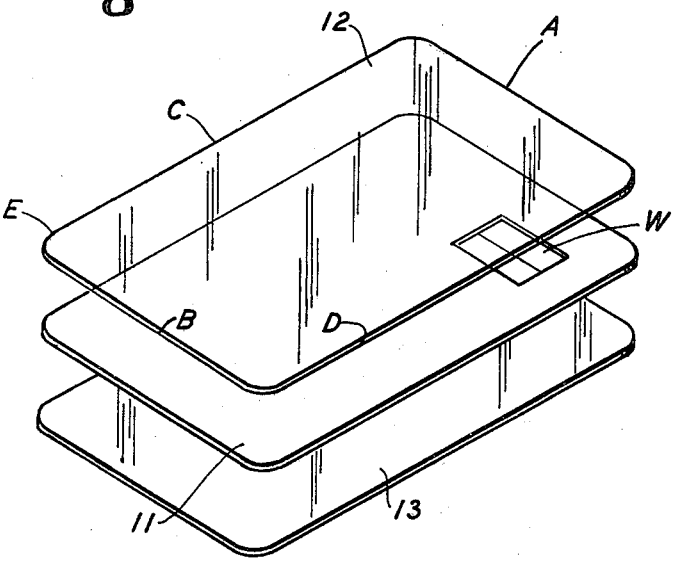
Fig. 2
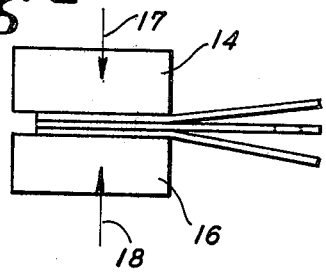
Fig. 3
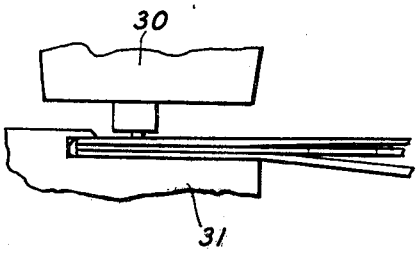
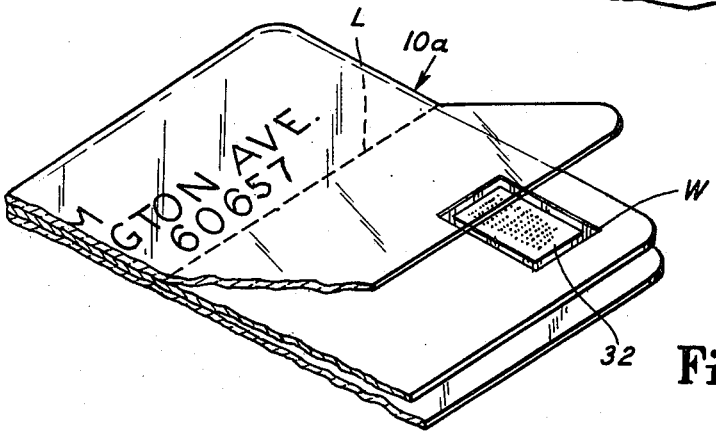
Fig. 4
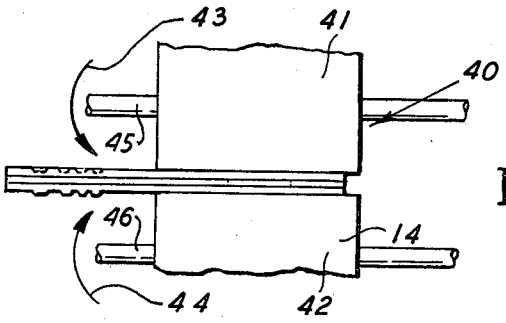
Fig. 5

Fig. 6
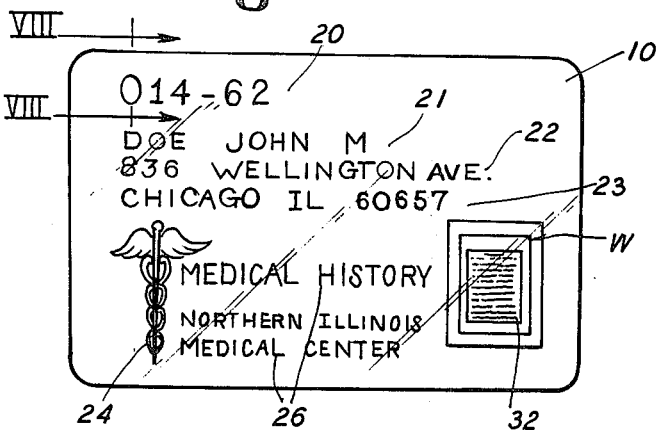
Fig. 7
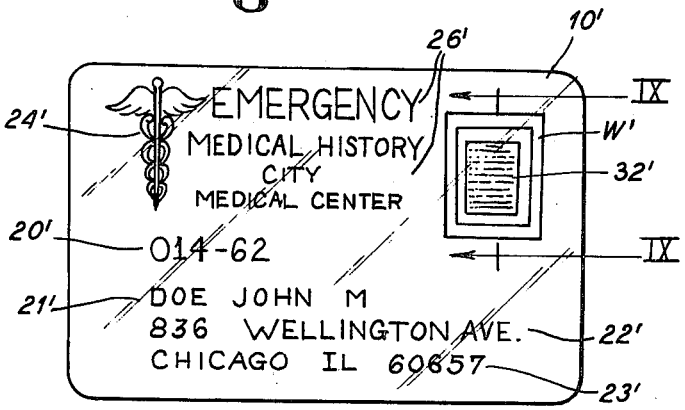
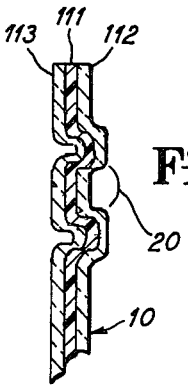
Fig. 8
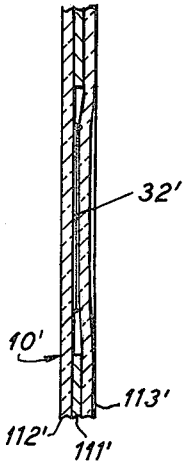
Fig. 9

COMBINED MEDICAL AND/OR INFORMATIONAL IDENTIFICATION CREDIT CARD

BACKGROUND OF THE INVENTION (a) Field of the Invention

This invention relates generally to plastic cards and methods of affixing indicia thereto.

(b) Background of the Invention

This invention relates to a combined medical/informational identification credit card and to a method of manufacturing such cards. Medical/i.d. cards resemble credit cards in appearance. They accommodate an informational chip such as a microfilm insert containing medical history and/or credit data concerning the cardholder. By present standards of production, a card is produced with several steps which are time-consuming and hence expensive. For example, to emboss the name of the cardholder on the card after a microfilm chip is inserted, an operation requiring thirty to forty seconds per card is required, thereby cutting down production of the producer to sixty to seventy cards per hour. With such a card, for example, a three-ply lamination is provided in which the center core is apertured to receive a piece of microfilm. The two outside panels are transparent. The three laminations are heat-laminated for fusion and then the cardholder's name is mechanically inscribed upon the card. Because the microfilmed document is not readable by the human eye without separate viewer equipment, verification of the microfilm data with the personal and/or credit data about to be embossed into the card must be a separate step for each card. Further, if this time-consuming verification step is omitted, a single microfilm card being "out of sequence" with the embossing operator's index list, could result in all the following cards being embossed with the wrong identification data. Thus, both the embossing time and the cost of microfilm processing, inserting, and laminating would be wasted.

In the case of most medical institutions, a number corresponding to a credit card identification is a computer-generated number which is also computer correctable through means of various codes with preassigned values to each digit. If such numbers are duplicated manually, considerable human error is embodied in the process.

In the laminated card technology, there is also a technique known as spot laminating which has been common in the "laminating pouch" industry in the form of either two heat seals or a thin strip seal across one edge of the unit for the sole purpose of positioning the outside laminates of a unit together.

SUMMARY OF THE INVENTION

In accordance with the principles of the present invention, a multiple part card, for example, a three-part card is prelaminated from either the top or bottom, thereby providing enough laminated area to imprint up to four or more lines of descriptive characters while still leaving the remainder of the card open for later insertion of an informational part such as a microfilm chip and/or a photograph of the user.

By having the card with a pre-laminated fraction such as a pre-laminated half, computer-generated and correctable data from the memory of a computer which originates the data may be printed on the card via a computer-operated imprinting device, such as an embosser or straight printer, at virtually the speed of light.

Thereafter, the microfilm chip or the photograph can be matched to the plate on the card after the prelaminated cards are delivered to a hospital site or to a dealer and locked in place by full lamination of the card.

There is thus provided a two-stage or two-step process which can be performed at different selected sites so that local services can be used in the "on-site" microfilming of health records. Moreover, if the partially laminated card is utilized, computer-imprinting at high speed can be effected without concern for the microfilm insertion which will be accomplished at a later date and thereby maximum economy in imprinting will be obtained. The microfilm chip or photograph can then be compared to the name that is printed on the card as it is being inserted.

BRIEF DESCRIPTION OF THE DRAWINGS

FIG. 1 is an exploded perspective view of a three-ply card in a first stage of fabrication;

FIG. 2 is a schematic view of thermal fusion apparatus showing a three-ply card in a second state of fabrication;

FIG. 3 is a somewhat schematic view of an embossing head showing a three-ply card being embossed by means of a computer regulated embosser in a third state of fabrication;

FIG. 4 shows a fourth stage of fabrication wherein a microfilm chip is inserted along an unlaminated portion of a three-ply card;

FIG. 5 is a schematic view of thermal fusion apparatus wherein the unlaminated portion of the three-ply card may be completed in a fifth stage of fabrication;

FIG. 6 is a front elevational view of a card constructed in accordance with the principles of the present invention with one selected format;

FIG. 7 is a front elevational view of a card embodiment using a different layout format;

FIG. 8 is an enlarged fragmentary cross-sectional view taken along the lines VIII—VIII of FIG. 6; and FIG. 9 is an enlarged fragmentary cross-sectional view taken along the lines IX—IX of FIG. 7.

DESCRIPTION OF THE PREFERRED EMBODIMENT

The present invention is applicable to any microfilmed credit card or medical alert card, but has a special utility in connection with a combined medical alert/identification/credit card and to a method of making same. Although other imprinting techniques are within the contemplation of the present invention, the preferred embodiment reflects the present state of the art which is to emboss cards with user data.

There are basically two types of embossing formats used in the manufacture of wallet-sized plastic credit cards, specifically, an "A" plate and a "B" plate layout which defines whether or not the embossed area is in the upper half of the card or the bottom half of the card. The "A" plate location is defined by the limitations of the embossing machine, but normally centers around the top half of the card. The "B" plate location can go anywhere from the top middle, down to the lower edge of a typical plastic card, as is the practice with most of the plastic credit cards issued on behalf of various gas and oil companies.

In view of such established past practices with wallet-size credit cards, it is contemplated by the present invention that there will be a card provided as shown generally at 10 in FIG. 6 and which will be adapted to be of wallet size, i.e., approximately $2\frac{1}{8}$ inches by $3\frac{3}{8}$ inches (53.975 millimeters by 85.725 millimeters).

It is specifically contemplated that the card of the present invention will be a so-called three-part card, although cards can be made from any of two or more parts. Accordingly, the card shown generally at 10 in FIG. 6 is shown in greater detail in FIGS. 1–5 as including a central core laminate 11, a top laminate 12 and a bottom laminate 13 sandwiching the core between them. The core 11 may be opacified while the laminates 12 and 13 are transparent if so desired. In most cases, the central core laminate 11 would already be pre-printed on one or both sides with the hospital's or institution's identification and/or logo.

The three parts 11, 12 and 13 are sheet-form in physical character and are cut and shaped to be of equal size so that they may be laminated together in the form of an integrated unit. All of the parts 11, 12 and 13 are to be made of heat-fusible plastic material; or the core 11 may be made of different material, such as paper, while the laminates 12 and 13 are made of heat-fusible plastic. Each respective member has end edges indicated at A and B respectively and side edges C and D, respectively. The corners are rounded on a radius as at E. Thus, in the exemplary form of the card shown in FIG. 1, the length of the card is on the A-B axis.

In the particular embodiment shown, the core part 11 is provided with a window or cut-out in which can be inserted a customized informational part such as a microfilm chip or a photograph or any other indicia bearing element which is desired to be incorporated as a integral part of the card. The window or opening is shown at W and in this form of the invention, for purposes of illustration, the window W is located in the lower right-hand corner, using the planes of orientation of FIG. 1. With respect to the possible embossing formats, it will be appreciated that the form of the invention illustrated in FIG. 6 contemplates that the so-called "A" plate could be provided with the embossed area in the upper half of the card, that is extending between the edges A and B but on the half of the card closely adjacent the edge C.

On the other hand, a so-called "B" plate layout would locate the embossed area in the bottom half of the card, i.e., extending from the end edges A and B and on the half most closely adjacent the edge D, as shown in FIG. 7.

It should be understood that in referring to the terminology "top half" or "bottom half" of a card, we intend to embrace within the scope of such terminology the usual practice in the art. For example, because the embossing of up to four lines of identifying data will physically require from approximately 30% to 70% of a typical credit card height extending from the edge C to the edge D, it will be appreciated that the "half" of a card is not precisely defined in terms of 50% of the overall height of the card between the edges C and D.

Cards of the type referred to are particularly helpful in identifying an individual by his name as well as by his home address. In addition, if the card is used for credit purposes, it is also desirable to assign a credit card number to each individual cardholder.

In the case of most medical institutions, the credit number is a computer-generated number which is also computer correctable through means of various codes with preassigned values to each digit. It is contemplated in accordance with the teachings of the present invention, therefore, that if the card of the present invention is to be utilized by a medical institution, the customer could customize the card based on its preference of utilizing embossment of information either on the top half of the card or on the bottom half of the card in accordance with the existing imprinting system utilized at the institution. Typically, a hospital or medical center will have a large investment in imprinting equipment which is designed to imprint a lower half card embossing such as the lower extremes of a "B" plate impression or vice versa, such as the upper extremes of the "A" plate impression. Consequently, the customer would be supplied with a card prelaminated on either half with the microfilm or photograph aperture W situated in the opposite half for film insertion.

Referring to FIG. 2, there is shown a laminating machine having an upper heating element 14 and a lower heating element 16. Vertical arrows are shown at 17 and 18, respectively, to indicate possible use of a pressing operation for performing the lamination. It will be understood that in the case of a pressing operation, elements 14 and 16 would be platens containing the usual heating elements and properties (e.g., nickel cadmium bars) necessary to effect a thermal bonding or thermal fusion of the card parts 11, 12 and 13. One skilled in the art will readily appreciate that other methods of heat sealing could be used to perform the laminating step shown in FIG. 2. For instance, a pressure roller operation could be utilized wherein heating elements would rotate over the card. Pressure rollers permit continuous lamination of a moving web of card material. Other methods for heat sealing, for example, infrared heat lamps using parabolic mirrors for direction intensity, could also be utilized alone or in combination with the above-cited operations.

In accordance with the principles of the present invention, the card parts are only partially bonded together in a localized area by heat sealing during the stage of production shown in FIG. 2. Thus, there is produced an intermediate article which is illustrated in FIG. 4 as constituting a card **10*a* wherein one half of the card, above the dotted line L, is a bond heat-sealed integral laminate while the other half, below dotted line L, constitutes an unbonded half of discrete separated parts. By virtue of such provision, the intermediate card unit 10*a* lends itself to having computer-generated and correctable numbers and other indicia embossed from the computer memory that orignated them. It is, therefore, contemplated that a medical institution, for example, would send a quantity of the intermediate cards 10*a*** along with their computer tapes to an embossing center which would have the hardware to automatically feed the intermediate cards through a computer generated embosser. The pre-embossed cards which have been personalized without the intervention of human error are now ready for microfilm insertion and final lamination by either a local microfilm service company or the medical institution.

Referring to the drawings, and specifically FIG. 6, it will be noted that at the top there is a line of number information shown at 20 which could typically constitute a credit identification number of the user. At 21, there is indicated a line of indicia information which could correspond to the name of the user. At 22 there is a line of information which could correspond to the Post Office address of the user. At 23 there is a line of information which could correspond to the city, state and zip code of the user. An informational part 32 is provided in the window or cut-out W located in the lower right-hand corner of the card 10. The lower left-hand portion of the front panel could be supplied with art work 24 and printed indicia 26 depending upon the requirements of the user. A so-called "A" embossing format is shown in FIG. 6, while a so-called "B" embossing format is illustrated in FIG. 7.

The card 10' shown in FIG. 7 contains elements corresponding to those shown in FIG. 6. The corresponding elements are represented by the same reference numerals utilized in FIG. 6, but these numerals are primed in FIG. 7. Consequently, the embossed line of number information which could typically designate a credit identification number of the user is shown at 20' and located in the bottom half of the card 10'. The remainder of the typically embossed information, i.e., the user's name shown at 21', address shown at 22', and city, state, and zip code shown at 23', are located beneath the credit identification number 20' in the bottom half of the card 10'. The upper left-hand portion of the card 10' contains the art work 24' and printed indicia 26'. The window W' containing a microfilm chip or photograph 32' is located in the upper right-hand portion of the card 10'.

In any event, shown schematically in FIG. 3 is embossing mechanism including an embossing head 30 and a backing block 31. The imprinting mechanism will emboss all of the cards on the prelaminated half with information from a computer memory that originated the information.

Thereafter, as shown in FIG. 4, a microfilm chip containing, for example, medical information or a photography of the user would be matched to the name on the card and such chip as shown at 32 would be inserted in the window or opening W.

One of the card units with embossment 20 formed is shown in enlarged fragmentary section in FIG. 8. The card 10 shown in FIG. 8 is a three-ply card unit having an "A" plate layout. In this particular "A" plate card unit, the core laminate 111 is made of an opaque heat-fusible plastic, while the top 112 and bottom 113 laminates are made of transparent heat fusible plastic. After the informational part 32 is inserted in the window W, the card parts 11, 12 and 13 are heat bonded together along the remaining unlaminated area of the card unit. The lamination of the card is completed as shown in FIG. 5 wherein an additional laminating machine is shown at 40. Heating elements 41 and 42 are pressure rollers rotating over the card about shafts 45 and 46, respectively, in the directions shown by lines 43 and 44. Similarly as discussed in connection with the laminating step shown in FIG. 2, one skilled in the art will readily appreciate that other methods of heat sealing could be utilized to perform the final laminating step shown in FIG. 5. For example, the heating elements could be platens operated in accordance with a suitable pressing mechanism. An informational part such as a medical history microfilm chip or photography 32' is shown affixed in place in FIG. 9. For this particular "B" plate card, the core laminate 111' is made of paper, while the top 112' and bottom 113' laminates are made of transparent heat-fusible plastic.

There is thus provided a card and a method of making the same which affords production economies with a high degree of accuracy and with a minimal chance of human introduction of error.

Although various modifications might be suggested by those versed in the art, it should be understood that we wish to embody within the scope of the patent warranted hereon all such embodiments as reasonably and properly come within the scope of our contribution to the art.

We claim as our invention:

1. A combined information and credit card unit comprising:

a plurality of laminar parts made of heat-fusible plastic, said parts being selectively partially heat-fused along an area of discrete size to form a pre-laminated half and said parts being unattached along the remaining area to form an unbonded half, machine-imprinted indicia formed in the pre-laminated half of the card unit from a computer memory that originated such indicia, and a window formed along the remaining area in a laminar core to receive an information member inserted in said window, so that said unbonded half parts can be fused a substantial time after said pre-laminated half is formed to make the card unit into an integral unitary laminar whole.

2. The card as defined in claim 1 wherein:

said information member consists of a microfilm chip.

3. The card as defined in claim 1 wherein:

there are three laminar parts.

4. For use in a medical institution, a three-part card made of heat-sealable plastic and having a pre-laminated half adapted to receive directly imprinted thereon computer-generated and correctable numbers, said three-part card including a core member having a window formed therein adapted to receive an informational part, said window being formed in that area of said card not part of said prelaminated half, whereby the card unit can thereafter be completed by heat sealing into an integral unitary laminar whole.

5. A combined information and credit card comprising:

at least two laminar parts made of heat-fusible plastic and a laminar core element, a portion of said plastic parts being heat-fused onto said core element over a localized area of discrete size to form a pre-laminated half of a card unit for receiving indicia machine imprinted directly thereon and said core element having a window for receiving an information member inserted therein, said window being formed in that area of said core element not part of said pre-laminated half of said card unit.

6. The card as defined in claim 5 wherein:

said pre-laminated half of the card unit has embossments formed therein corresponding to machine-imprinted indicia.

7. The card as defined in claim 6 wherein:

the machine imprinting said indicia is computer-operated.

8. The card as defined in claim 5 wherein:

said information member is a microfilm chip.

9. For use in a medical institution, a three-part card made of heat sealable plastic and prescribing a generally rectangular body of wallet-sized configuration with the length of the card disposed symmetrically relative to a center axis, said three-part card including a central core laminate, a top laminate and a bottom laminate sandwiching said central core laminate therebetween, each of said three parts being sheet form members and having a discrete portion of the card on one side of the center axis partially integrally prelaminated, said central core laminate having a window cut-out formed in a portion thereof spaced on the opposite side of the center axis and the adjoining top and bottom laminate portions constituting initially discrete separate parts, a customized informational part inserted and received in said window, and heat bonds adapted to join said initially discrete separate parts into an integrated unitary card.

10. The invention of claim 9 and further characterized by said customized informational part comprising a microfilm chip, and said prelaminated portion of said card being embossed to form a pressure-resistant type font.

11. The invention of claim 9 and further characterized by said customized informational part comprising a photograph, and said prelaminated portion being embossed to form printing characters.

* * * * *